United States Patent [19]

Shields

[11] Patent Number: 5,045,983

[45] Date of Patent: Sep. 3, 1991

[54] COMPUTER CONTROLLED LIGHT WITH CONTINUOUSLY VARIABLE COLOUR TEMPERATURE, COLOR, MAGNIFICATION, FOCUS, AND POSITION

[76] Inventor: Gary A. Shields, 134 Northgate Drive, Welland, Ontario, Canada, L3C 5Y5

[21] Appl. No.: 514,466

[22] Filed: Apr. 25, 1990

[30] Foreign Application Priority Data

Apr. 26, 1989 [GB] United Kingdom ..... 8909515

[51] Int. Cl.[5] ..... F21V 9/00

[52] U.S. Cl. ..... 362/293; 362/268; 362/319

[58] Field of Search ..... 362/16, 17, 18, 268, 362/293, 301, 319

[56] References Cited

U.S. PATENT DOCUMENTS

| | | | |
|---|---|---|---|
| 3,818,216 | 6/1974 | Larraburu | 362/293 X |
| 4,602,321 | 7/1986 | Bornhorst | 362/293 X |
| 4,620,791 | 11/1986 | Combastet | 362/293 X |

*Primary Examiner*—Stephen F. Husar
*Attorney, Agent, or Firm*—Arne I. Fors

[57] ABSTRACT

A lighting system is described having an electronic means for controlling the color, color temperature, magnification and focus in response to predetermined signals from a computerized system. A wide spectrum light beam having a wavelength of from 380 nm to 700 nm is passed through a heat absorbing condenser to control the predetermined color temperature thereof and said portion of the beam is separated into a first color beam having a wavelength of from 445 nm to 450 nm, a second color beam having a wavelength of from 555 nm to 570 nm and a third color beam having a wavelength of from 525 nm to 535 nm. The separated color beams are maintained at substantially equal focal length an the intensity of the respective color beams varied in response to an electronic signal. The color beams are then combined to form a composite beam of predetermined color. The colour and intensity of the resulting beam is thereby more accurately predetermined.

1 Claim, 11 Drawing Sheets

FIG.1d.
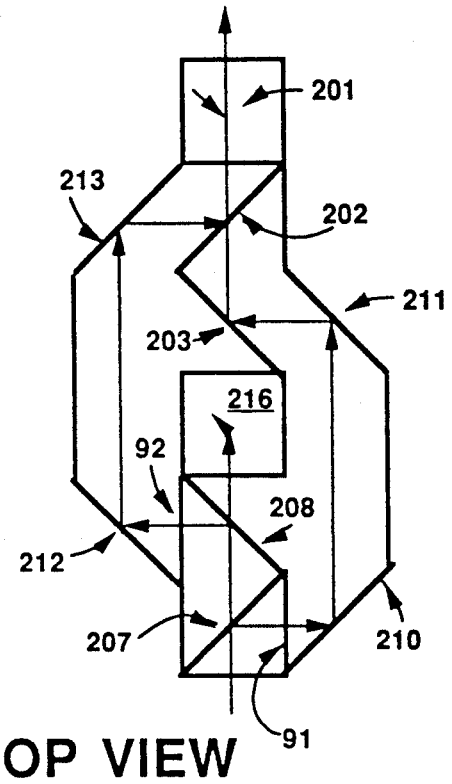
TOP VIEW
FIG.1e.
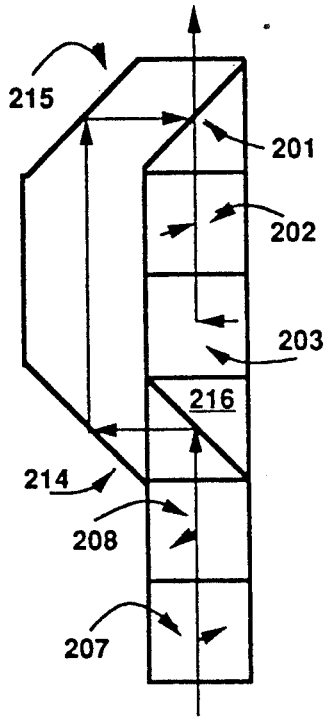
SIDE VIEW
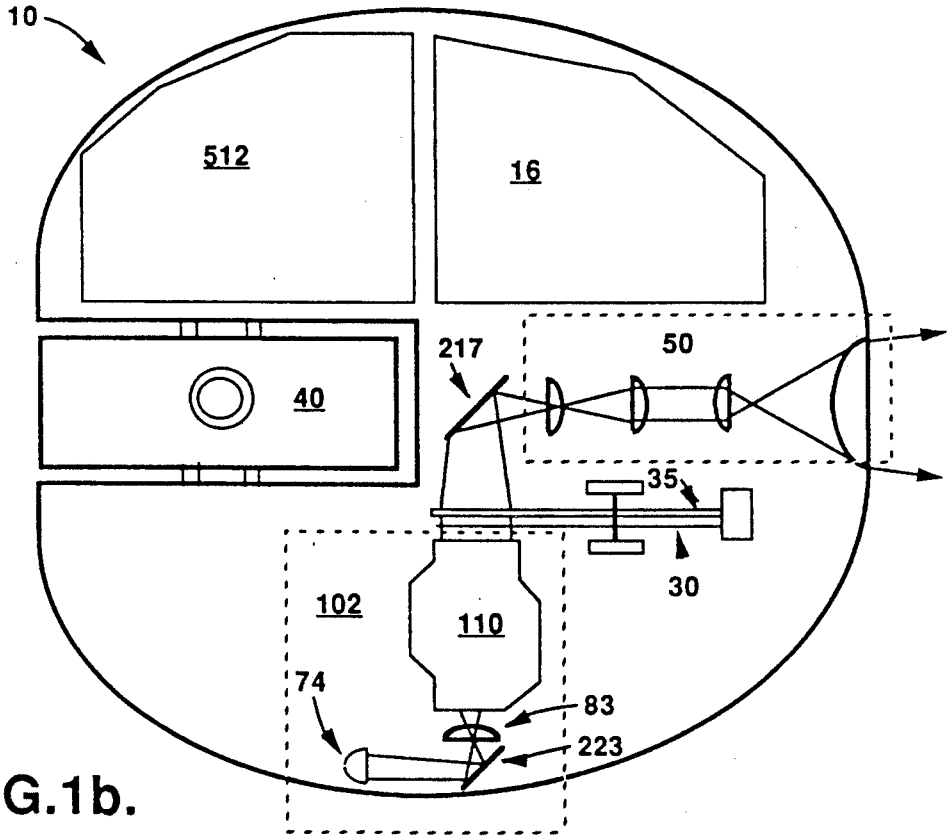
FIG.1b.

FIG 1f.
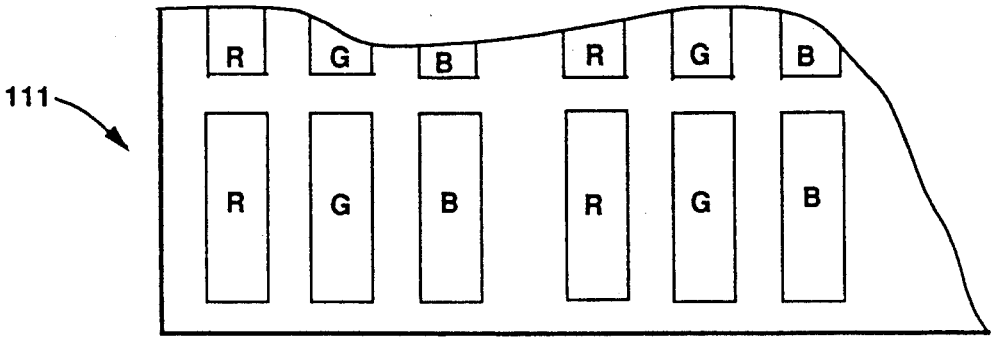
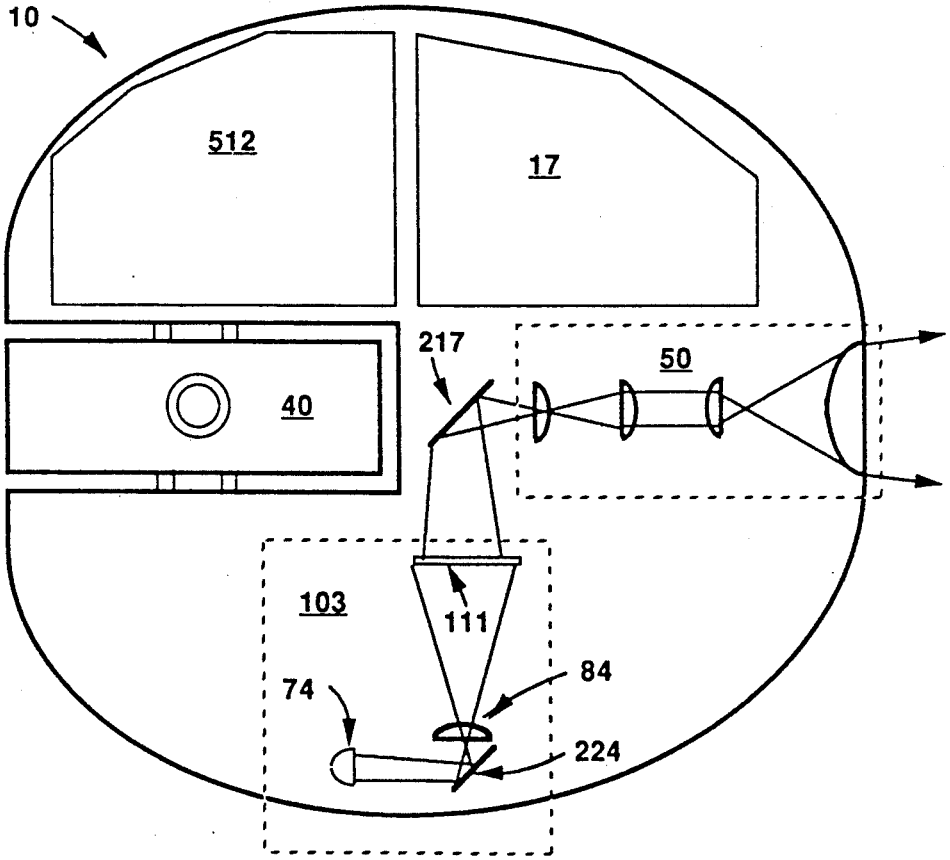
FIG 1c.

ONE THIRD OF CIRCUIT 16
DUPLICATE FOR EACH LCD WINDOW 92,93.

GOBO WHEEL

COMPUTER CONTROLLED LIGHT WITH CONTINUOUSLY VARIABLE COLOR TEMPERATURE, COLOUR, MAGNIFICATION, FOCUS, AND POSITION

TECHNICAL FIELD

This invention relates to the illumination, in particular to the lighting of live stage and theater, as well as film and television.

BACKGROUND ART

The lighting of stage, theater, film and television has in the past typically been done with conventional lights. These lights have only limited capabilities and can generally perform only one function per light. This requires a great many lights to achieve the desired illumination effect.

Typically, lights are fixed in a specific location and can produce only one given colour. The shape of the beam that is projected is normally fixed as well. These elements of position, colour, and beam shape are determined when the lighting design is being carried out. When the lights are installed for the performance, they are adjusted to produce the desired effect.

The position of the light, or for that matter, the position of the image thrown by the light, is controlled by the position the light is mounted on the truss or other supporting member and the alignment of the light. The colour is controlled by placing a coloured material in the path of the light beam to produce the desired hue and saturation. The intensity of the light beam is generally determined by a power control device off stage and separate from the light itself. The beam shape is controlled by either focusing the beam at different distances to produce different degrees of beam divergence, or by placing a gobo or some other template in the path of the beam which alters the shape of the projected beam.

When a gobo is used to alter the shape of the light beam, the image is projected using varying degrees of focus to produce both sharp and soft projected images. The problem with this system is that in order to get a sharp image at the distance that you want to project, the image may not be the size that you desire due to the fixed focal length of the projecting lens.

While a large range of coloured materials exist for placement in the path of the light to alter the colour, these materials only change the hue and saturation of the light beam but not the colour temperature of the actual light source. This is very important for the film and television industry, where the cameras are very sensitive to variations in the colour temperature of the light source. A common problem is the filming of a scene in an environment where artificial lighting is required and a natural source of light already exists as well. The problem begins when the colour temperature of the two light sources are different from each other. This requires that one of the light sources be filtered to match both the colour temperature of the other light source and the film as well. This creates inefficient light sources and increased costs. Sometimes large areas such as windows need to be covered with the filter material. This is done to convert the light coming from a source on one side of the window into a compatible colour temperature with the light on the other side of the window.

A further problem with these coloured materials is that they work by absorbing all the wavelengths of light except the ones that are desired to produce that particular colour. The result is that the filters absorb the unused wavelengths of light and convert them into heat, typically melting or discolouring the filter from the heating effects. This means that they have a short life span and need constant replacing.

A more obvious problem of this form of light colouring is that you can only produce one colour from the coloured material.

The light sources also produce a substantial amount of heat. This intense heat from the lights is very unpleasant for the performers on stage and a constant problem in the close up world of television and film, where the heat from all the lights can spoil makeup and other heat sensitive effects that have been created.

Since the lights are fixed in a particular location, they do not possess the ability to be pointed at another location during the show. This increases the number of lights that need to be used during the performance.

A partial solution to some of the above problems is described in U.S. Pat. No. 4,392,187 to Bornhorst. His system includes a light which can produce a number of colours and vary the beam divergence and position of the projected image. In his system, the colours are produced by introducing a number of coloured filters into the path of the light beam, that instead of absorbing the unused portion of the light, reflects it off the surface of the filter. This helps to eliminate some of the heating effects that occur in the filters and increases their life span. By adjusting the position of these filters in the path of the light beam, a number of colours can be achieved. The heat from the light source still escapes from the light and lands on the stage, still causing discomfort and heating the objects in the path of the light. While this invention can produce a range of colours, this method cannot produce a continuous range of colours.

A method of producing a continuous range of colours is described in U.S. Pat. No. 4,535,394 to Dugre. His system uses three primary coloured light sources, which he combines using two dichroic mirrors into a single light beam.

While the basic optical idea is feasible, it is inefficient due to the extra filtering of the light sources that is required to produce the three primary coloured light sources. If the filtering is performed using the coloured materials that are used on conventional lights, then this system will fall prey to the same heating effects that ruin these materials on the conventional lights. This would mean that the light would fail before the performance was finished and you would constantly need to replace the coloured material. Although not specified in the patent, it is more likely that the same sort of dichroic filters that are used in the Bornhorst invention previously described, would be used here because of the ability to reflect unwanted wavelengths, which cuts down on the heating of the filters from this waste light. The problem with these dichroic filters is that they are heat sensitive. The heating effects from the high power light sources will cause a temperature induced colour drift in the primary filters. This will vary depending on the present intensity of the individual lights. This will make it difficult, if not impossible to accurately produce a desired colour at any given time due to the unknown degree of colour shift that has occurred at that point in time.

If the light sources are left on constantly, the colour shift can become quite substantial.

The heat will also cause aging of the filters, which will show up as a permanent shift in colour. This will necessitate the frequent replacing of these rather expensive filters.

The means of control of the intensity of the three primary light sources, and the indecisiveness of the exact amount of the three primary colours that are being added, makes the control of the colour temperature of the light, not to mention, the exact colour being produced, impossible. This form of controlling the light will allow only course changes in colour, and would not achieve much more of a range of colours than the Bornhourst invention previously mentioned. However, since an additive method of colour generation is being used, rather than the previously mentioned method of discrete filters, a continuous range of colour can be produced.

A further problem with the Dugre invention is that the optical systems he has described will not produce a single clean coloured light beam. The length the light travels from each of the three light sources is different, and therefore the angle of divergence of the three light beams will be different. This causes the composite beam to appear as three overlapping cones of light when it reaches the stage. Any shadow produced on the stage by a beam of light from this optical system will not produce one distinct shadow, as would a single coloured beam, but rather a number of separate and differently coloured shadows behind the performer on stage. This is a distracting side effect and not really suitable for use in illumination of stages or other types of performances. A true single beam of light would produce only one clean shadow, with no colour separation occurring.

The heat from the light sources is still able to reach the stage in this optical design causing all the above mentioned problems.

None of this known art teaches a light that has a continuously variable colour temperature, as well as continuously variable colour, which can be repeatedly produced, and further, which can produce a variable sized image, that can be focused over a large range of distances, and carries no heat in the light beam falling on the stage.

DISCLOSURE OF THE INVENTION

The present invention provides a lighting system, which includes at least one light which has a directable beam of light. The colour temperature, colour, magnification and focus of which can be continuously varied, and has no heat remaining in the light beam. A pivoting mechanism is provided to point the light beam at any location on the stage. The CPU and control electronics receive and transmit information on a two way fiber optic communication link.

In accordance with another aspect of the invention, a method of producing the coloured light beam is provided. One such method is via the use of three wide spectrum light sources. These three light sources have the heat and ultraviolet light removed from the beams which are then condensed down to a sharply defined disk to be projected by the front lens system. After being condensed, the three beams strike a special mirror. Three such mirrors exist, one for each beam. Each mirror reflects a specific portion of the visible light at an angle of 90 degrees from the original path. The three mirrors are positioned in such a way that the three reflected beams are coincident on each other.

This forms a new composite beam of light, the colour of which is determined by the intensity of the three beams before they reach the reflecting mirrors. The intensity of the light sources is determined by the control electronics. This control mechanism has sufficient precision as to make possible very minor and exact adjustments in the intensity of each light source.

In accordance with yet another aspect of the present invention, a second means of producing a variably coloured light beam is provided. This method uses only one wide spectrum light source which does not require variable intensity control. The light from this source has any heat and ultraviolet light removed from the beam and is then condensed down to a sharp disk to be further processed by the optical system. This light beam now enters an electronic colour generating prism. This prism separates the single light beam into three equal light beams. These three light beams pass through their own liquid crystal windows. The windows control the intensity of the light beams. After the intensity is determined, portions of the three white light beams are recombined to form a single coloured light beam which emerges from the prism. The recombining of the light is performed by the same type and arrangement of mirrors that are used in the first method of colour generating. The difference being that now the mirrors are produced by surfaces inside the prism. The control electronics associated with the liquid crystal windows affords sufficient precision in the control of the light transmitting ability of the liquid crystal as to allow the same precise adjustments in the intensity of the three beams of light.

In accordance with yet another aspect of the invention, a third method of producing a coloured light beam is presented. This method uses a single white light source, which has any heat and ultraviolet light removed from the light beam, and is condensed to flood a liquid crystal panel with light. This liquid crystal panel contains a matrix of tiny liquid crystal windows. The intensity of each window can be individually controlled. The windows are arranged into groups of three in such a way that each member of the group transmits a different primary colour. Since the windows are so tiny, and they are so close to each other, they appear as one single spot, the colour of which is determined by the intensity of the light leaving each window in the group.

In accordance with yet another aspect of the invention, a CPU is provided, which exchanges information with the main control computer (not covered in this document) running the lighting system. The computer inside the light sends information to the control electronics which determines what colour is being produced, what colour temperature the light beam has, where the light beam is pointing, the size of the final image, the degree of focus, and any other optionally included functions.

BRIEF DESCRIPTION OF THE DRAWINGS

The following illustrations may help to clarify the description of the invention.

FIG. 1*a–f* are views of the light which utilize the three embodiments of the light sources forming the present invention;

DETAILED DESCRIPTION OF THE INVENTION

Figure 1A:
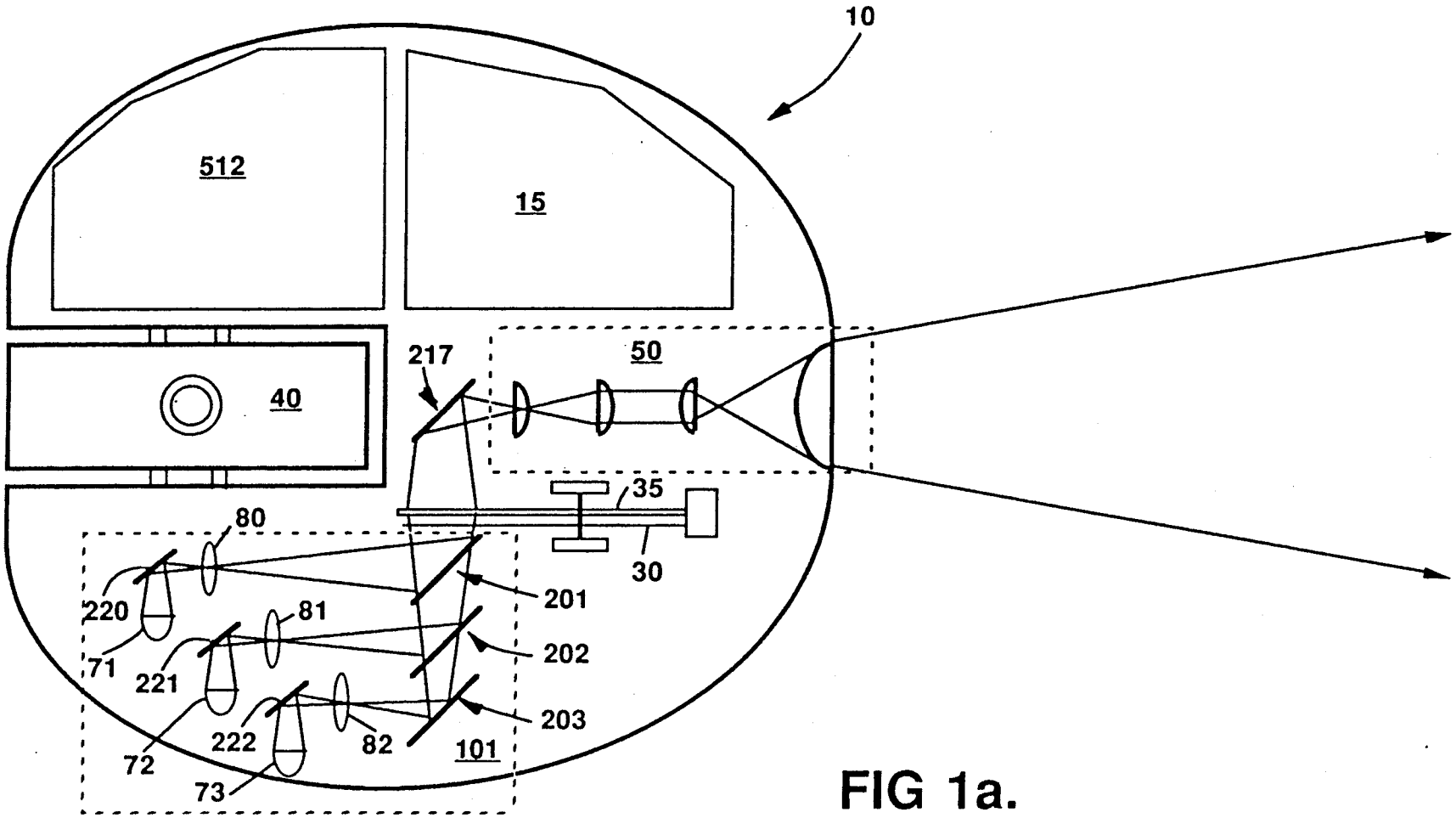

Referring now to the drawings, wherein like reference characters designate like or corresponding parts through several views, FIG. 1*a–f* illustrates the light (10) forming the present invention. The present form of the main control computer can direct over 1000 of these, or other conventional lights. The light (10) forming the present invention can be used for live theater, stage, television, or film lighting, both in and out of doors.

The main control computer is responsible for storing all the information needed to direct the lights to produce whatever lighting effect that is desired. All light show designing, previewing, and direction, is carried out on the main control computer. The information that is needed to instruct a light (10), is sent to the light via the fiber optic communication link (60) from the main control computer.

Figure 5:
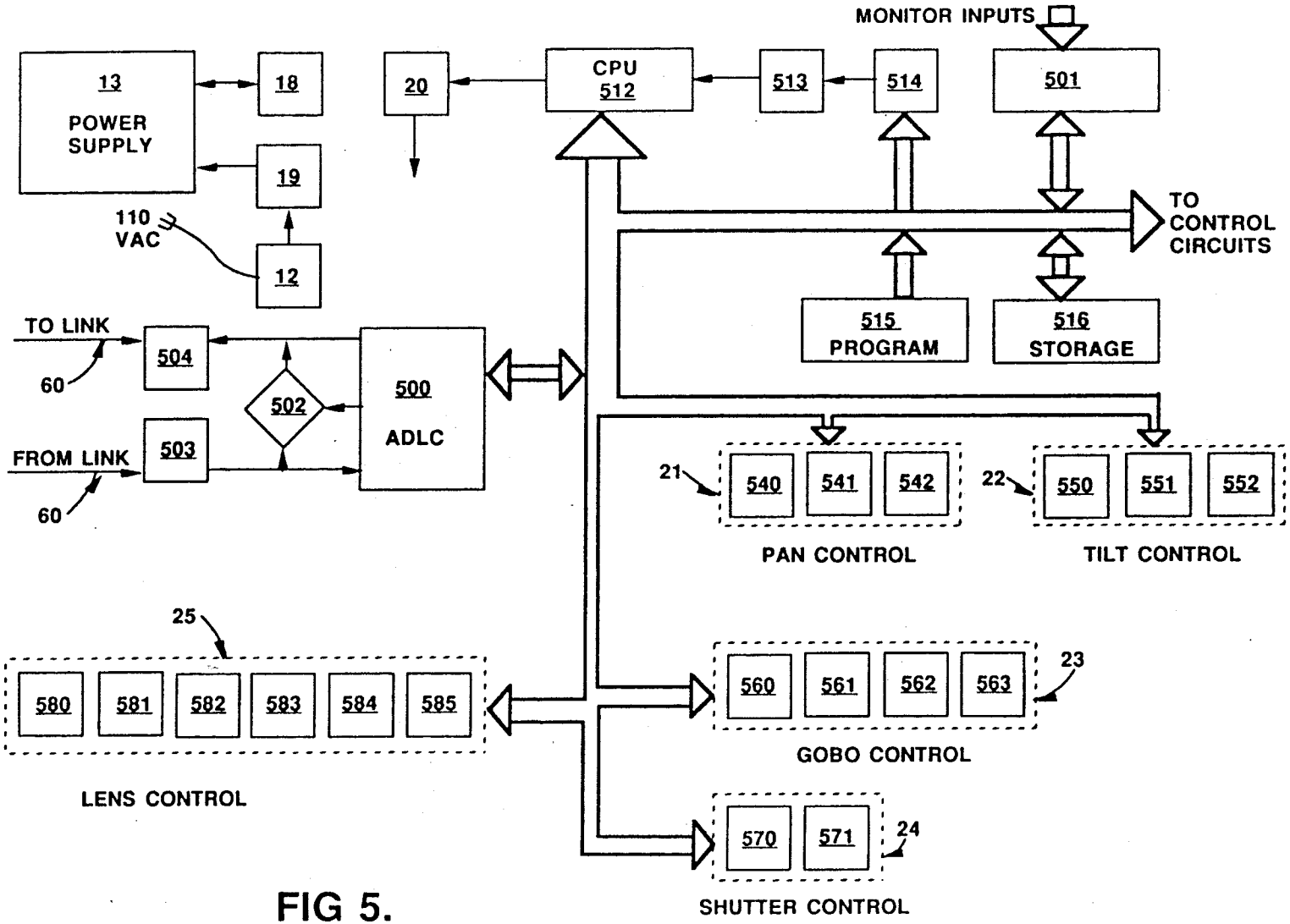
FIG. 5 is a block diagram of the electronics that remain the same through all three embodiments of the light forming the present invention.

Referring now to FIG. 5, the organization of the control board inside the light (10) forming the present invention will be discussed. The information to instruct the light (10) is received via the fiber optic link (60). When the light (10) is in a non-active state, the information is simply echoed via the transmitter (504) back out into the fiber optic loop (60). When the light (10) receives instructions to go online and become active in the loop, the automatic bridge (502) between receiver (503) and transmitter (504) is broken, and the advanced data-link controller (ADLC) chip (500) takes over the echoing process. The ADLC chip (500) is used in the loop configuration mode and offers a very high degree of data transmission integrity. The ADLC (500) uses the "Advanced Data Communication Control Procedure" (ADCCP) protocol when communicating, and thus handles all address control, error detection, and information formatting. The use of the ADLC (500) along with the fiber optic connecting cable (60), provides a virtually error free data link with the main computer.

The fiber optic cable (60) is immune to electrical noise which plagues other serial communication methods, and with the ADLC (500) advanced communication protocol, insures that a light never responds to an errored transmission. The second advantage of using this combination of the ADLC (500) and the fiber optic cable (60), is that the data transmission rate can be high enough that two way communication can be carried out on the data link (60). This means that the lights (10) can report status information back to the main control computer by simply passing it along the data loop (60). The ADCCP protocol ensures that each light (10) only responds to the packets of information that were addressed to it and provides a mechanism for the interleaving of information packets transmitted from the lights (10) in between the information packets from the main control computer. This helps insure the reliability of the entire lighting system, since if a light (10), where to detect a malfunction via the monitoring circuits (501), the light (10) would be able to instruct the main control computer of the problem and shut itself down. The main control computer would then reorganize the lighting cues, and substitute a redundant, functioning light (10) into the light show, instead of trying to use an already malfunctioning light (10). In this manner, even if a light bulb were to burn out, there would be no interruption of the light show on stage. Using the ADLC (500), the light (10) can be instructed to respond to different addresses while the show is running. This allows any light (10) to instantly change the address it responds to, thus making substitutions very easy to accomplish.

Still referring to FIG. 5, the CPU (512) is responsible for overseeing all the functions that are being carried out by the light (10). All functions of the light (10) are monitored by a failure detection circuit (501). Every aspect of the light that can be controlled is monitored by this circuit. This enables the light (10) to pick up on any malfunction immediately, and shut itself off before any disruption of the light show can take place. As soon as the error is detected, the main control computer is informed, and the operator can take appropriate action. Even the CPU (512) is monitored by a failure circuit. The light (10) has a one second count down timer (514). During the normal course of running programs, the CPU (512) will reset this timer (514) before it reaches one second. If however the CPU (512) has malfunctioned, the timer (514) will reach one second before the CPU (512) can reset the timer (514). Upon reaching one second, the timer (514) activates a master reset circuit (513) which turns off the light (10) and takes the light off line. If the CPU (512) is functioning correctly after this reset, then the light (10) will put itself back on line and continue running lighting sequences. However, if the CPU (512) fails to show that it is running correctly, then the main control computer will substitute a redundant light (10) to continue the light show. The programs for the CPU (512) are in the program memory (515). The programs stored here are responsible for all the functions that the light (10) can perform. The storage memory (516) is used for temporary storage of information as it is sent and received, as well as intermediate values of calculations. The lighting instructions come in through the receiver (503) and are stored in the storage memory (516). Here they are decoded and expanded using programs stored in program memory (515).

The CPU (512) then prepares in the storage memory (516) the values that need to be sent to the various control registers which control the functions of the light (10). Every feature of the light (10) is run by loading a set of values into a control register that corresponds with that function. Once the control registers are loaded, the control electronics (14) take over the function and perform it automatically. This relieves the CPU (512) from alot of extra overhead that would degrade the performance of the light (10). The CPU (512) can monitor the control electronics (14) operation, via the monitoring circuits (501). In this way the CPU (512) will know if the light (10) is performing the functions the way that the light (10) is supposed to be. The main function of the CPU (512) is then to decode and prepare instructions for the control electronics (14), and to detect any malfunction in the light (10) and to report it to the main control computer. The advantage of each light (10) having a built in computer makes it possible for the light (10) to perform lighting effects that are far more complicated than any conventional light can perform, and in many cases, effects that are impossible with any other type lighting system.

Still referring to FIG. 5, there are still several portions of the electronics which do not change between the three embodiments of the control electronics. They are the power supply (13), fan control (20), pan function control (21), tilt function control (22), gobo control (23), shutter control (24), and lens control (25). The light (10) is powered by a single 110 vac line. The power supply (13) conditions the 110 vac and produces all the other voltages that are required by the light (10).

There is a high degree of special filtering that is carried out by the power supply as well. First the input to the power supply is protected by a series of transient arrestors (12). These protect the electronics inside the light (10) from lighting strikes on the 110 vac line. After lightning protection, the 110 vac line is filtered with an EMI choke (19). This filter (19) prevents any Electro Magnetically Induced noise from entering the power supply lines feeding the CPU (512) or the control electronics (14). Noise of this type could cause an error to occur, so its elimination from the power supply is necessary to ensure the reliability of the light (10). The supply lines feeding the CPU (512) and the control electronics (14) are also filtered individually every few inches on the printed circuit board as well. This prevents any local voltage disturbances from causing problems with the other electronic components in the circuit. Finally, the CPU (512) and the control electronics (14) are battery (18) backed up. This way, should there be a power failure, the battery (18) will continue to provide power for the vital portions of the light (10). Then, when the power is restored, the light (10) will not have lost any data, and still be completely ready to perform the lighting tasks.

The pan function (21) is controlled by three registers, pan speed (540), pan direction (541), and step count (542). The values stored into these three registers will control which direction the light (10) will pan, how fast the pan will be, and how far to pan.

Figure 4:
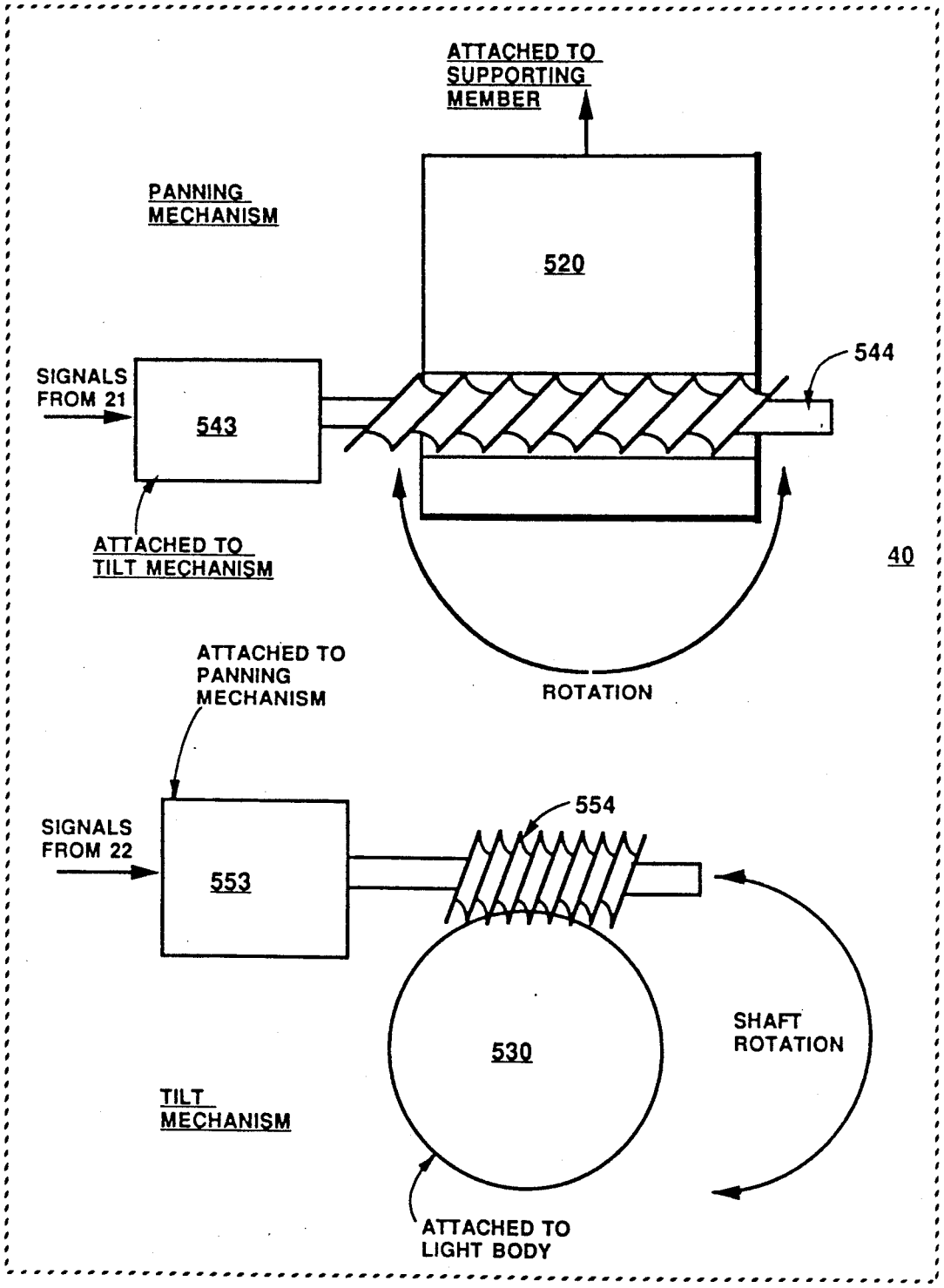
FIG. 4 shows the pan and tilt mechanism forming the present invention.

Referring now to FIG. 4, the panning is performed by a stepping motor (543), controlled by the signals derived from the pan control electronics (21). The stepping motor is connected to a gear reducing mechanism (544), which causes the body of the light (10) to rotate horizontally about supporting shaft (520).

Referring again to FIG. 5, the tilt function (22) is controlled in a similar way with the three registers tilt speed (550), tilt direction (551), and step count (552).

Referring now to FIG. 4, the tilting is performed by a stepping motor (553), controlled by the signals derived from the tilt control electronics (22). The stepping motor is connected to a gear reducing mechanism (554), which causes the body of the light (10) to rotate vertically about supporting shaft (530).

It can now be understood that the light (10) can be moved in the horizontal plane (panned) as well as in the vertical plane (tilted) to point to any location on the stage or surrounding area.

Figure 3A:
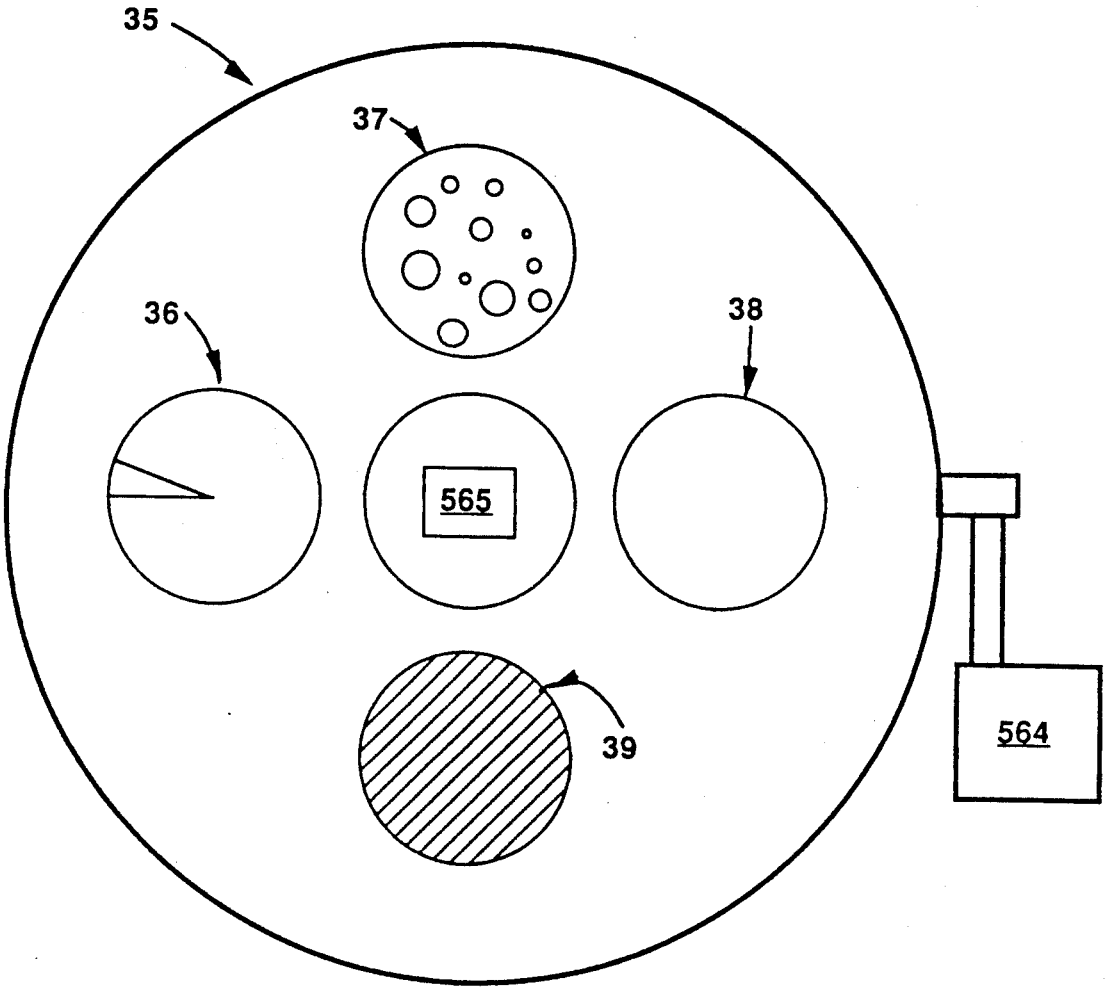
FIG. 3*a–b* are views of the optional gobo wheel and shutter mechanism forming the present invention.

Referring back to FIG. 5, the optional gobo wheel (35) is controlled by the registers wheel position select (560), gobo rotation speed (561), gobo rotation direction (562), and rotation step count (563). The wheel position register (560) controls the rotation of the gobo wheel (35) to place the desired gobo (36,37,38,39) in the path of the light beam. The gobo wheel (35) is rotated by a stepping motor (564). The other three registers control the direction, speed, and length of time the gobo (36,37,38,39) is rotated in the light beam. Referring to FIG. 3*a*, the individual gobos (36,37,38,39) are rotated by the same stepping motor (565). This ability to rotate a gobo (36,37,38,39) while in the light beam enables unique special effects. One such effect, impossible with conventional lights used in industry, is a kaleidoscope effect. This is produced by taking a gobo (36) which produces a small wedge of light and rotating it in the light beam fast enough that it produces what appears to be a continuous circle of light due to persistence of vision. By changing the colour of the light beam as the wedge passes different positions in the circle, a multicoloured circle is perceived by the eye.

Figure 3B:
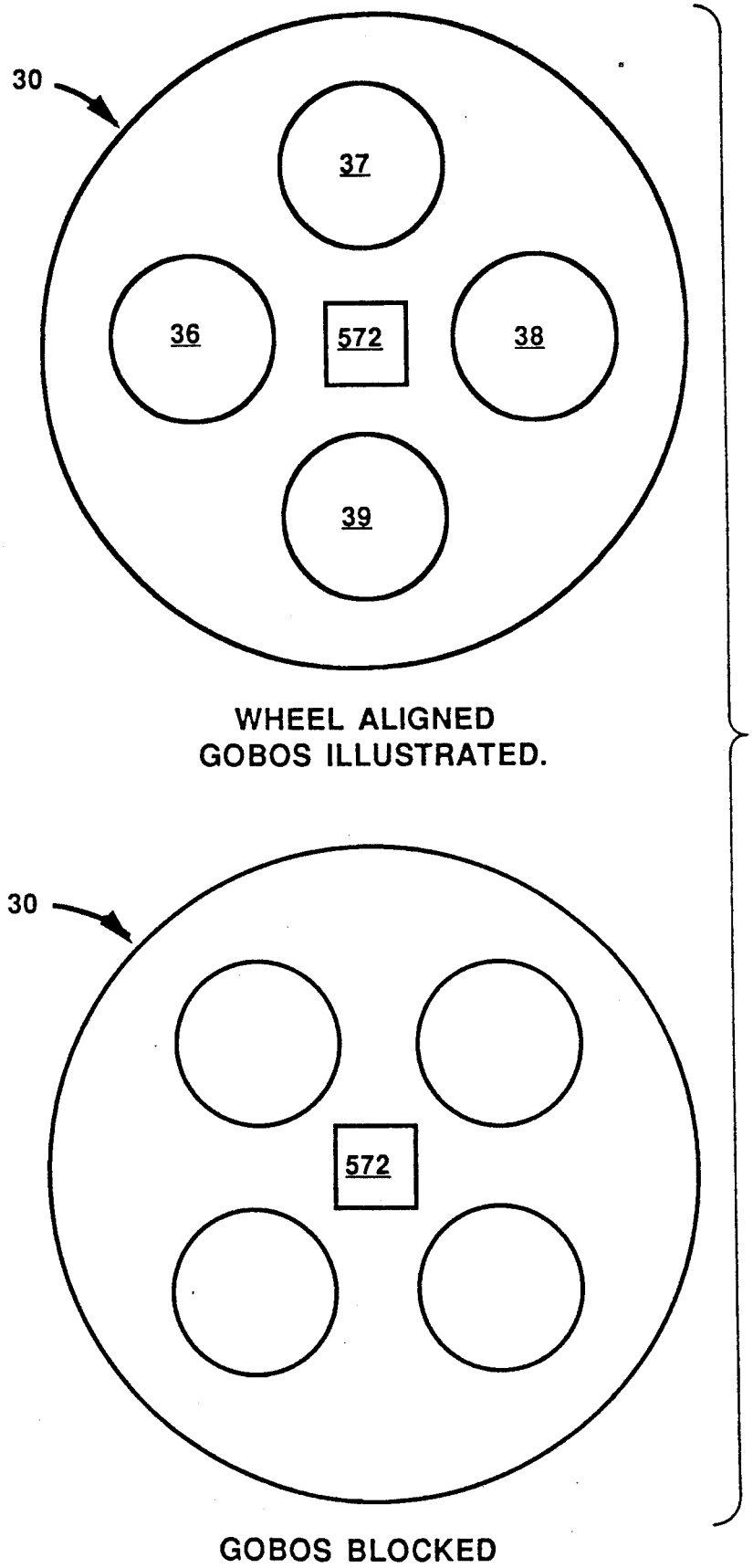

Referring now to FIG. 3*b*, a stroboscopic effect can be generated by the shutter mechanism (30) associated with the gobo wheel (35) inside the light (10). The shutter (30) consists mainly of a disc the same size as the gobo wheel (35), with holes that correspond in size and location with the holes in the gobo wheel (35). The gobo wheel (35) and the shutter wheel (30) are mounted coaxially. When the holes in the two wheels (30,35) are aligned correctly, the light beam can pass through both wheels (30,35). But when the shutter wheel (30) has been rotated by a stepping motor (572), the holes will no longer line up and the light is blocked off. By controlling the rotation of the shutter wheel (30), a strobe light effect can be produced.

Referring back to FIG. 5, the method of controlling the shutter wheel (30) is by the control registers wheel speed (570), and wheel step count (571). These two control registers are responsible for the synthesizing of the motor drive signals that rotate the shutter wheel (30) the exact amount, and at the correct speed, to produce the strobe effect.

Still using FIG. 5, the lens system (50) is controlled by the control registers actuator #1 direction (580), actuator #1 speed (581), actuator #1 step count (582), actuator #2 direction (583), actuator #2 speed (584), and actuator #2 step count (585). The control registers (580,581,582) produce signals that control linear actuator #1 (588), which is responsible for moving lens element #2 (52). The control registers (583,584,585) are responsible for producing 6 signals that control linear actuator #2 (589), which moves lens element #3 (53).

Figure 6:
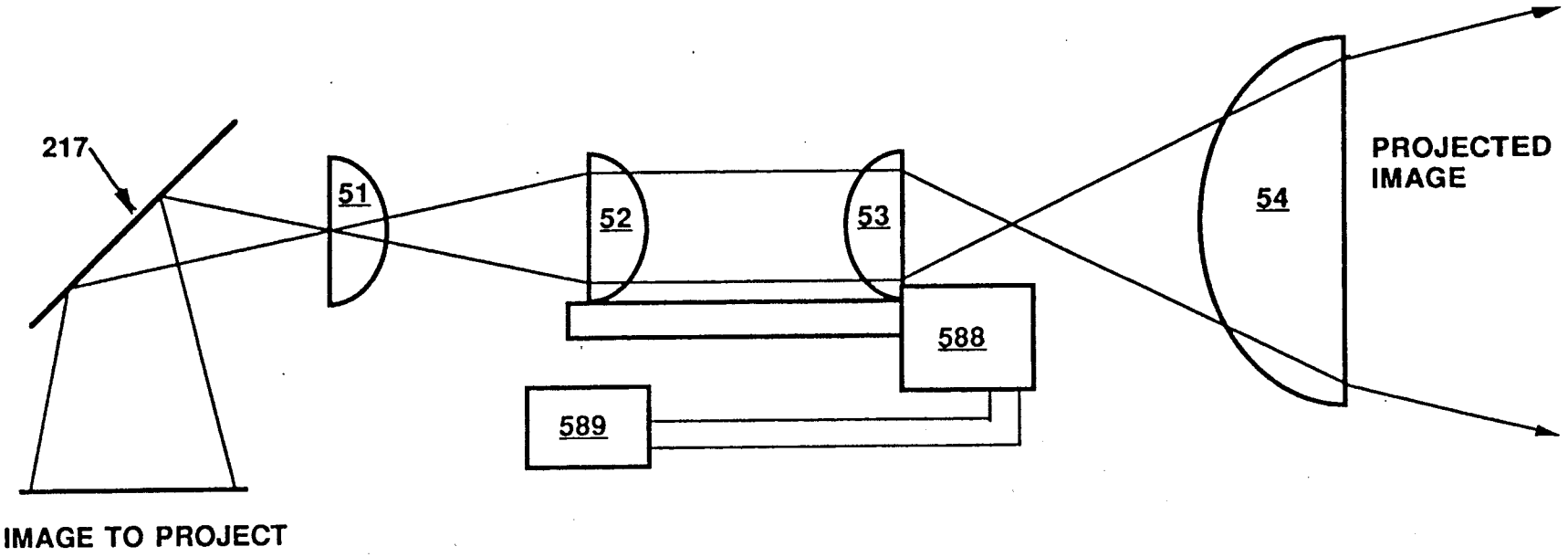
FIG. 6 is the front lens system used in the present invention.

Referring now to FIG. 6. The image to be projected is reflected into the front lens system by a first surface mirror (217). The front lens system (50) is comprised of four lens elements (51,52,53,54). Two of the lens elements (51,54), are fixed in position, while the other two lens elements (52,53), are movable. The first lens element (51) picks up the image of one of the gobos (36,37,38,39) or the liquid crystal panel (103) and projects it with a reduced image size to a fixed point within the lens system (50). The next two lens elements (52,53), work together as a duplet lens. The spacing of the two lens elements (52,53) is controlled by linear actuator #1 (588). This variable distance between the two lens elements (52,53) in the duplet causes the duplet to have a variable effective focal length. The second linear actuator (589) controls the position of the duplet between the first and last lens elements (51,54). By manipulating both the effective focal length of the duplet, and the position of the duplet, a variable focus, variable magnification lens can be achieved. The reduced image from the first lens element (51) is picked up and magnified by the second and third lens elements (52,53) and projected to a point inside the lens system (50). The position of the projected image from the second and third lens elements (52,53) determines where the image will be focused when projected by the final lens element (54). The image picked up by the final lens element (54) is magnified further, and projected to the stage. With the correct positioning of the second and third lens elements (52,53), the front lens system (50) can produce a light beam whose angle of divergence can be varied from 4 degrees to 64 degrees. Furthermore, due to the nature of the lens system (50), the beam can be focused from a distance of at least 15 feet, to infinity. Due to the variable focal length and position of the second and third lens elements (52,53), a variety of magnifications of the image of gobos (36,37,38,39) or the liquid crystal panel (103) can be produced at the final focal point of the lens system (50). This differs from the art previously described, where the image size is a function of where the image is focused, and are not independently controlled as described above.

Referring to FIG. 1*a*, the first method of producing the coloured light beam will be discussed. White light produced by a wide spectrum source (71) is reflected at an angle of 90 degrees by a mirror (220). This mirror (220) reflects light between the wavelengths of 380 nm. to 700 nm. This essentially removes all short wave ultraviolet and infrared radiation. The light reflected from this mirror (220) will have almost all of the heat and harmful ultraviolet radiation removed. This light will produce virtually no heating effects or ultraviolet light related fading effects. The light reflected from this mirror (220) is condensed by a heat absorbing condenser lens (80) which removes any heat that may have been reflected by the mirror (220) and projects this light to illuminate one of the gobos (36,37,38,39). Before the light reaches the gobo wheel (35), the light is reflected 90 degrees by a mirror (201). The mirror (201) is placed in such a way that the light reflected from it will fall on the selected gobo (36,37,38,39). The mirror (201) reflects a narrow band of wavelengths which peak between 445 nm. and 450 nm. The wavelength boundaries that the mirror (201) reflects corresponds to the wavelengths that stimulate the receptors in the human eye which have been pigmented to respond to the blue colours. Therefore, the only light reflected by the mirror (201) is light that the blue receptors of the human eye will perceive.

This mirror (201) will transmit all other wavelengths of light that strike it. Since light falling on this mirror (201) is either reflected or transmitted, and the light falling on the mirror (201) has no infrared energy, the heating effects and consequent colour drifts are non-existent. Likewise, fading from ultraviolet light has been eliminated as well.

Next, white light from a second wide spectrum source (72) is reflected at an angle of 90 degrees off of another mirror (221). This mirror (221) has the same properties and performs a similar task to the first mirror described (220). The light reflected from this mirror (221) passes through a heat absorbing condenser lens (81) which performs a similar task as the previous lens (80). The light leaving this condenser lens (81) is reflected 90 degrees by a mirror (202). The reflected light from this mirror (202) falls on the first colour mixing mirror (201) which passes the light without disturbance. This second colour mixing mirror (202) reflects a narrow band of wavelengths which peak between 555 nm. and 570 nm. The wavelength boundaries of this second colour mixing mirror (202) correspond with the wavelengths that stimulate the receptors in the human eye which have been pigmented to respond to the red colours. Therefore, the only light reflected by this second colour mixing mirror (202) is light that the red receptors of the human eye will perceive. This second colour mixing mirror (202) will transmit all other wavelengths of light that strike it. As with the first colour mixing mirror (201), there are no heating or fading effects that occur.

Next, white light from a third wide spectrum source (73) is reflected at an angle of 90 degrees off of a third mirror (222) which has the same properties and performs a similar task to the other two mirrors (220,221) placed after the light sources (71,72). The light reflected from this mirror (222) passes through a heat absorbing condenser lens (83) which performs a similar task to the other two heat absorbing condenser lenses (80,81). The light leaving this condenser lens (83) is reflected 90 degrees by a third colour mixing mirror (203). The reflected light from this third colour mixing mirror (203) falls on the second colour mixing mirror (202) which passes the light without disturbance on to the first colour mixing mirror (201) which also passes this light without disturbance.

The third colour mixing mirror (203) reflects a narrow band of wavelengths which peak between 525 nm. and 535 nm. The wavelength boundaries of this third colour mixing mirror (203) correspond with the wavelengths that stimulate the receptors in the human eye which have been pigmented to respond to the green colours. Therefore, the only light reflected by this third colour mixing mirror (203) is light that the green receptors of the human eye will perceive. This third colour mixing mirror (203) will transmit all other wavelengths of light that strike it. As with the previous two colour mixing mirrors (201,202), there are no heating or fading effects that occur. The three colour mixing mirrors (201,202,203) are arranged in the order of blue (201), red (202), green (203), to maximize the range of intensities available from the white light source. The white light source (70) has a smaller proportion of blue light making up the white light beam than it does red and finally green. Arranging the colour mixing mirrors (201,202,203) in the this order, obtains the greatest efficiency from the white light source (70) since the blue light passes through the least number of glass surfaces, followed by the red light and finally the green light.

Each glass surface that the light must pass through reduces the efficiency by a small percentage. This arrangement of the colour mixing mirrors (201,202,203) produces an almost equal balance of the three ranges of colour being mixed. The light (10) synthesizes different colours by stimulating the same proportions of receptors in the human eye as a particular colour of monochromatic colour would. This is an easy task since the wavelengths that the colour mixing mirrors (201,202,203) reflect match the wavelengths that the receptors in the human eye respond to. All that is needed is to control the intensity of the three white light sources (71,72,73) thereby controlling the proportions of the receptors that are being stimulated. The main computer knows the sensitivity of the colour receptors in the human eye and the spectral composition of the white light sources (71,72,73). This information is combined to calculate what intensity of each white light source (71,72,73) is needed to produce the same proportions of stimulation in the eye as the desired colour would. This information, along with the desired overall intensity of the perceived light, is sent to the light (10)

which uses this information to set the intensity of the light sources (71,72,73) accordingly. This setting takes into account the varying colour spectrum of the white light sources (71,72,73) at various intensities, and uses a closed loop feedback system to ensure that the proper ratios of light are produced to achieve the result desired. Since the colour mixing mirrors (201,202,203) reflect the light that matches the receptors in the eye, there is a direct correlation between the light beam exiting the light (10) and the receptors that the light will stimulate. This provides an very accurate method of simulating any desired wavelength of light. Care has been taken to ensure that the length of the path between all three light sources (71,72,73) to the gobo wheel (35) is equal. This ensures that the degree of divergence of all three beams will be the same. Then, when the three beams combine, there is no difference in the way that the light beams will focus and project. This eliminates any fringing effects in the shadows cast by objects on stage. The light beam leaving the light (10), is a crisp beam which appears as a single monochromatic light beam, leaving only one clean shadow. Previous art, while being able to produce coloured effects, cannot accurately and repeatedly produce a desired colour with the control and accuracy of this method.

There are several advantages to this type of colour control. First, this method of control affords the user with the ability of specify a colour by wavelength. In previous art, the user would have to adjust knobs until a colour resembling what they want appears on stage. This new method allows you to specify the wavelength of the light on a computer screen without having to adjust knobs or make visual determinations of the colour. A major advantage of this is for lighting designers who frequently design their lighting without even turning on a light. The colour they want is identified by a number corresponding to a coloured filter material. They usually can name the colours they want from their own memory. The main computer knows all the popular filters by number. The user can therefore just name the filter desired, and the main computer knows what wavelengths of light need to be passed in what proportions to produce that colour.

The second main advantage of this method of control of the colour, is that very minute adjustments in the colour can be made.

Many of these smaller adjustments will not be seen by the eye, due to the automatic white balance adjustments made by the eye, but will be obvious when recorded on film. These minute adjustments are actually changes in the colour temperature of the light. When we look at several different colour temperature sources of white light, we see them all as white. This is because of the automatic white balancing the eye performs. Film however cannot change the way it is balanced for white light. Therefore the different colour temperature light sources will photograph as different colours. The light (10) has the ability to make small and precisely controlled colour changes which give the light (10) the ability to alter the colour temperature of the light beam leaving the light (10). This is a very big advantage for lighting in the film industry, since now the designer can not only call up specific colour filtration by name, but can also specify the colour temperature of the light that the filter is placed in front of. The designer simply tells the main computer what colour temperature light source is desired, and what type of filter is to be used with that light source. The main computer takes all the information into account, and sends the instructions to the light (10) which precisely controls the light sources (71,72,73) to produce the desired result.

Figure 2C:
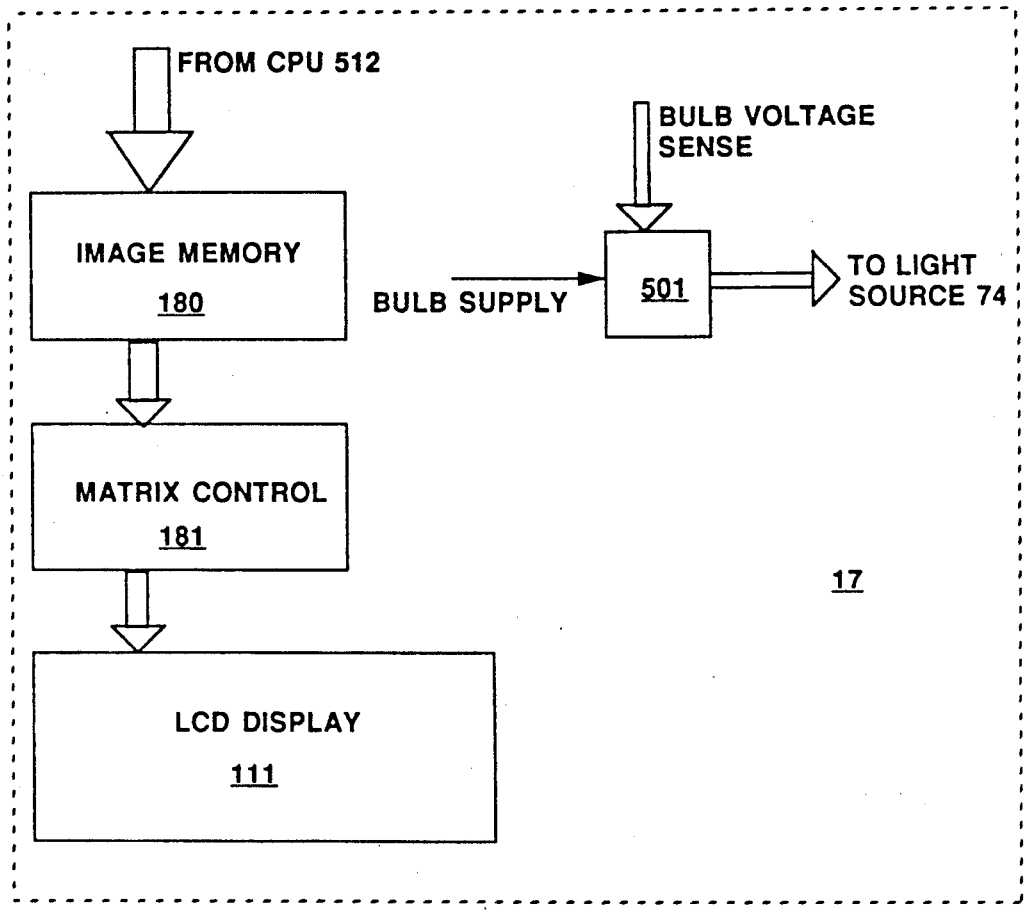
FIG. 2*a–c* are views of the three embodiments of the coloured light source and control electronics forming the present invention.
Figure 2A:
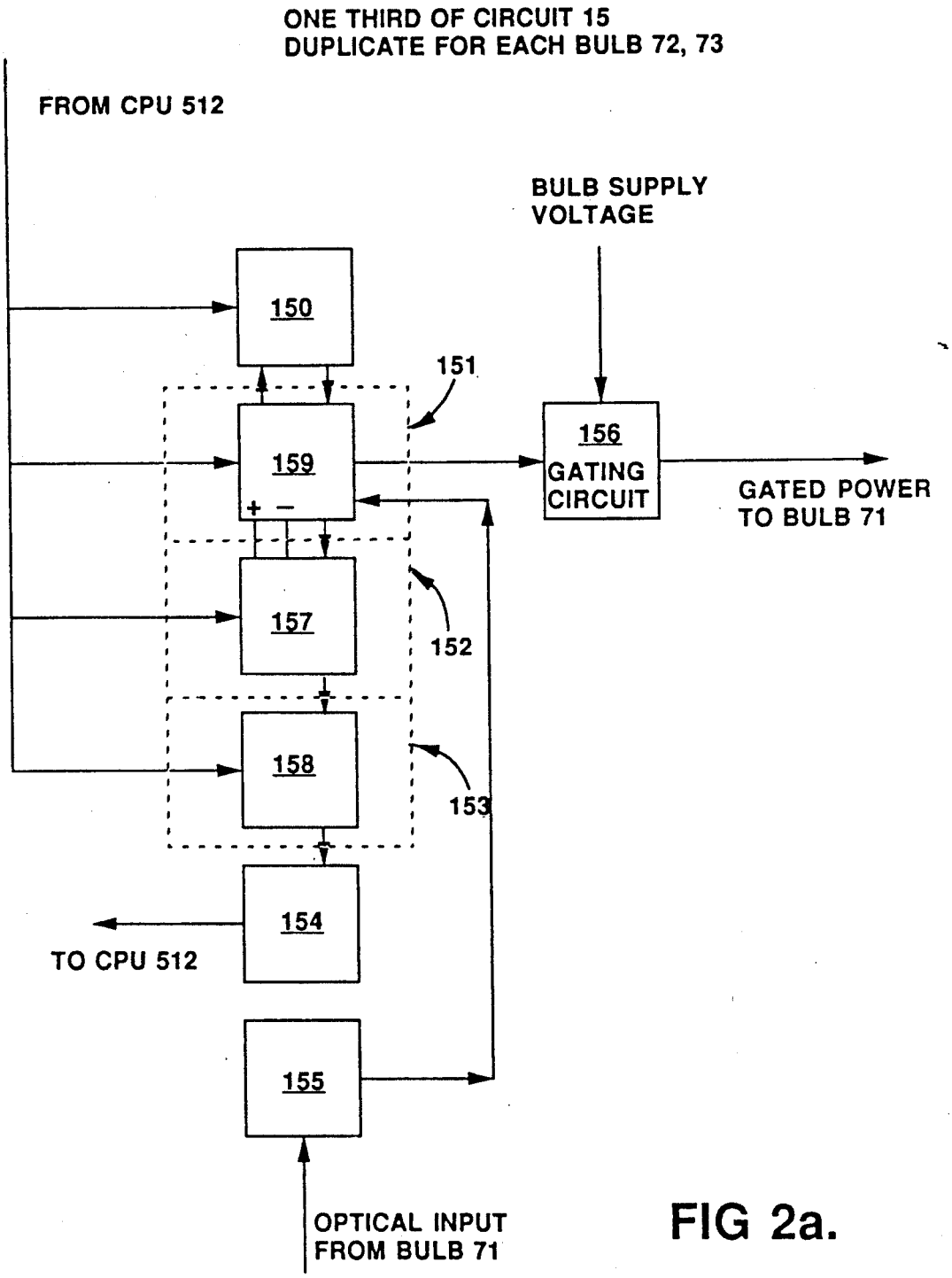

Referring now to FIG. 2*a*, the first embodiment of the control electronics will be discussed. The first embodiment of the control electronics (15) controls the intensity of the three white light sources (71,72,73). These three lights (71,72,73) are high output, low voltage incandescent bulbs. By using lower voltage bulbs, and having a closed loop feedback system, line voltage fluctuations of up to 30% can be tolerated with no degradation in the performance of the light (10). The control circuit (15) is duplicated for each of the three light sources (71,72,73). The control electronics (15) for each light (70) consists of six main parts. These are the frequency division circuit (150), the intensity control circuit (151), the intensity auto increase/decrease circuit (152), intensity change speed control (153), the interrupt generating circuit (154), and the feedback control circuit (155). The control electronics (15) has a very high resolution of control and can accurately produce 16,777,216 colour temperatures, each colour temperature having a range of 16,777,216 colours. The frequency division circuit (150) is responsible for the determination of the colour temperature of the light beam. This circuit controls the maximum intensity that a light source (70) can achieve and the resolution of the power control of that light source.

By controlling the maximum intensity, and the resolution of the remaining portion of the power envelope, the number of colours that can be produced with that colour temperature is maintained, while at the same time, the colour temperature of the light beam can be modified. The determination of a specific colour is carried out by the intensity control circuit (151). This circuit is responsible for gating a TRIAC power controller (156) at the precise point in time to deliver the correct percentage of power to the bulb (70) to achieve the desired colour. This percentage will vary as a function of the desired colour temperature of the finished light beam and the spectral composition of the source (70) at the present intensity. Both of these factors are taken into account and handled automatically by the frequency division (150) and intensity control (151) circuits. EMI filtering is used to eliminate any electrical noise which was produced by the gating circuit (156).

The desired intensity can be loaded directly into the intensity register (159) in the intensity control circuit (151) or automatically adjusted by the intensity increase/decrease circuit (152). This circuit is controlled by loading the new intensity into the control register (157). The speed of the change from one intensity to another is controlled by the speed control circuit (153). The rate of change in intensity is loaded into the speed control register (158). When the bulb has reached the new intensity, an interrupt is sent to the CPU (512) by the interrupt generating circuit (154). In this manner, the program can keep track of which bulb (71,72,73) has reached the desired intensity. The automatic feedback circuit (155) keeps the intensity of the light source (70) at the correct level by directly manipulating the intensity increase/decrease control circuit (152), or the frequency division control circuit (150). This ensures that when the CPU (512) loads the control circuit (15) with the desired colour temperature and intensity information, accurate results are maintained.

Refering now to FIG. 1*b*, the second method of producing a coloured light beam is discussed. White light from a wide spectrum light source (74) is reflected 90 degrees by a mirror (223) which reflects light between the wavelengths of 380 nm. and 700 nm. and transmits all other wavelengths of light. This essentially removes all ultraviolet and infrared light from the white light beam leaving the light source (74). The light reflected by this mirror (223) passes through a heat absorbing condensor lens (83) and enters the electronic colour generating prism (110). This prism (110) is responsible for generating the coloured light beam which will be projected by the light (10). The light beam entering the prism (110) first encounters a special mirror (207) which redirects 33% of the light on a path 90 degrees to the original path that was being taken. This reflected light falls on a liquid crystal window (91). The amount of light transmitted by this window is determined by the control electronics (16). Any light leaving this window is reflected 90 degrees by a first surface mirror (210). This reflected light is reflected 90 degrees again by a another first surface mirror (211). The refelected light from this second first surface mirror (211) falls on a special colour mixing mirror (203). This mirror reflects at an angle of 90 degrees, a narrow band of wavelengths which peak between 525 nm. and 535 nm. These wavelengths correspond to the wavelengths which stimulate the receptors in the human eye which have been pigmented to respond to the green colours. All other wavelengths of light striking this mirror (203) are transmitted straight through without disturbance.

The reflected light from this colour mixing mirror (203) is undeviated any further and exits from the prism (110) after passing through the other two colour mixing mirrors (202,201) which have no affect on the green light beam. The other 66% of the light which was not reflected by the first beam splitting mirror (207) now encounters a second beam splitting mirror (208). 50% of the light striking this second beam splitting mirror (208) is reflected 90 degrees while the remaining 50% travels on undisturbed. The reflected 50% equals 33% of the original light beam from the light source (74) and this reflected beam strikes a liquid crystal window (92). The light transmitting properties of this window is controlled by the control electronics (16). Any light transmitted by this window (92) is reflected 90 degrees by a first surface mirror (212).

The reflected light from this mirror is reflected 90 degrees by another first surface mirror (213). The light reflected from this second first surface mirror falls on the second colour mixing mirror (202). This second colour mixing mirror (202) reflects at an angle of 90 degrees a narrow band of wavelengths which peak between 555 nm. and 570 nm. which corresponds with the wavelengths that stimulate the receptors in the human eye which have been pigmented to respond to the red colours. All other wavelengths of light are transmitted without disturbance through this second colour mixing mirror (202). The light leaving this second colour mixing mirror (202) passes undisturbed through the last colour mixing mirror (201) without being disturbed and exits the colour generating prism (110). The 50% which was not reflected by the second beam splitting mirror (208) comprises the final 33% of the original light beam from the light source (74). This light encounters a liquid crystal window (93). The light transmitting properties of this window (93) being determined by the control electronics (16). Any light leaving this window (93) is reflected 90 degrees by a first surface mirror (214). This reflected light is reflected 90 degrees two more times by a pair of first surface mirrors (215,216). This serves to reroute the light beam so that it lands on the remaining colour mixing mirror (201). This final colour mixing mirror (201) reflects at an angle of 90 degrees a narrow band of wavelengths which peak between 445 nm. and 450 nm. which corresponds to the wavelengths which stimulate the receptors in the human eye that have been pigmented to respond to the blue colours. This final colour mixing mirror (201) will transmit all other wavelengths of light without disturbance. The light reflected by the final colour mixing mirror (201) exits the colour generating prism (110). It can now be seen that the single white light source (74) has been broken down into three equal light beams, whose intensity is electronically controlled by the light transmission properties of the three liquid crystal windows (91,92,93). The three intensity modified beams of light are routed through three different paths which ensure that all three light beams travel the same length before the three beams are recombined and leave the prism (110). The method of synthesizing colours is quite simular to the first method of producing the coloured light beam with the major differences being that only one light source is required, and the light source does not require intensity control, thereby making it easier to control the colour mixing process. The main similarity is the use of the three colour mixing mirrors (201,202,203).

This mixing system is more efficient then the systems used by the previous art, which required three separate sources of white light which further needed to be filtered to separate out the primary colours and then combine the three primary colours into a single beam.

This new system simply reflects only the portions of the spectrum which need to be combined to produce the desired colour. After leaving the prism (110), the coloured light beam either illuminates the optional gobo wheel (35), or is simply projected by the light (10).

Figure 2B:
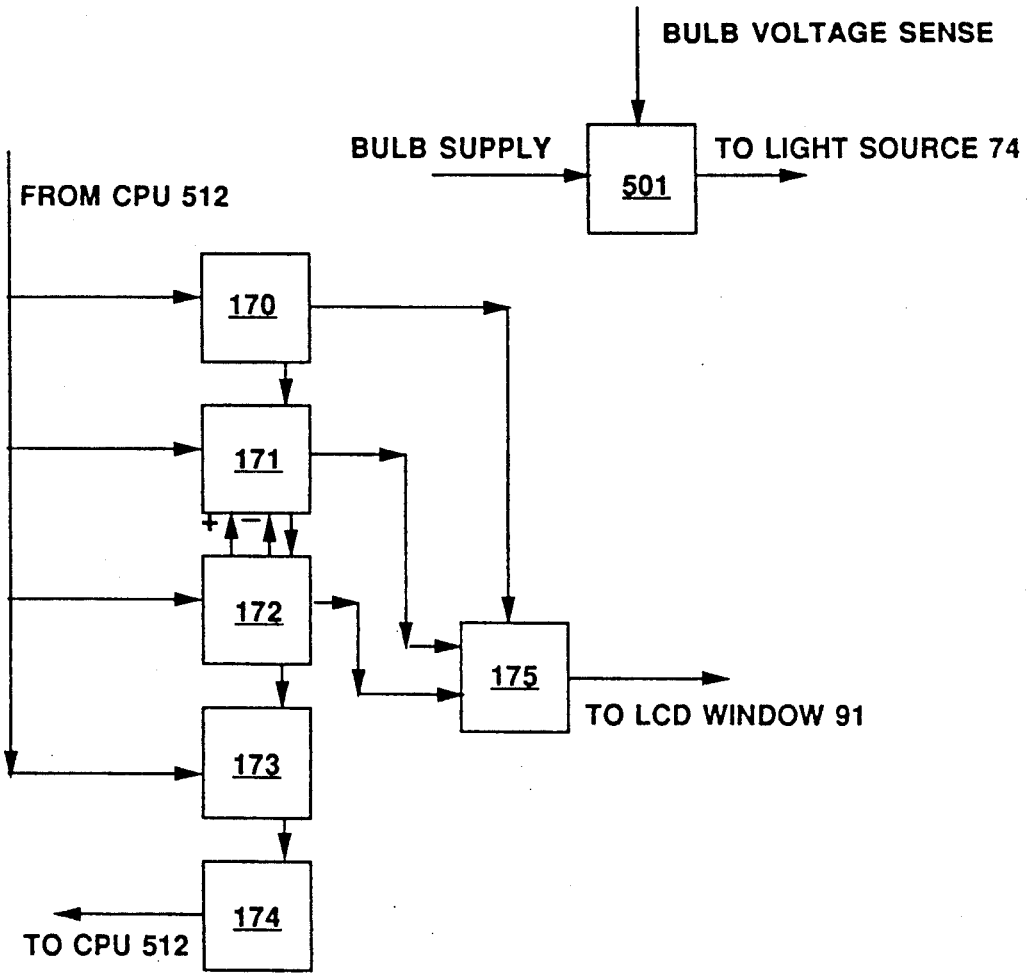

Referring now to FIG. 2*b*, the second embodiment of the control electronics will be discussed. The control electronics (16) consists mainly of six circuits. These six circuits exist for each of the three liquid crystal windows (91,92,93). The six sections of the control circuit are the colour temperature register (170), intensity register (171), the intensity increase/decrease register (172), the intensity change speed control register (173), the interrupt generating circuit (174), and the liquid crystal waveform generating circuit (175). The values corresponding to the desired colour temperature and colour are loaded into the appropriate registers (170,171). These two registers (170,171) are combined to provide the information to the waveform generating circuit (175) which sends the control signals that determine the light transmitting properties of the liquid crystal window (90). Each control circuit is identical and controls one of the liquid crystal windows (91,92,93). The white light source (74) requires only on/off control and this is done during the zero crossing of the power supply feeding the light source (74). This zero crossing control of the power eliminates any electrical noise that would otherwise be produced during the power control and eliminates any need for filtering of the power lines supplying the light source (74). The only other control that is performed is the closed loop feedback of the light source (74) via the monitoring circuit (501). This feedback eliminates any fluctuation in the power lines supplying the light source (74) and prevents these fluctuations from effecting the lights performance. Since the light source (74) does not require intensity control, there is no need to use an incandescent light source with this method of colour generation, and other high output light sources can be used instead.

The resolution of control of the colour temperature and the colour is the same as the first embodiment of the control electronics.

Referring now to FIG. 1*c*, the third method of producing the coloured light beam will be discussed. White light from a wide spectrum light source (74) is reflected 90 degrees by a mirror (224) which reflects light between the wavelengths of 380 nm. and 700 nm. and transmits all other wavelengths of light. This essentially removes all ultraviolet and infrared light from the white light beam leaving the light source (74). The light reflected by this mirror (224) passes through a heat absorbing condensor lens (84) and illuminates the liquid crystal display panel (103). The panel (103) consists of a matrix of tiny liquid crystal windows. These windows are arranged in groups of three. In each group of three, one window will pass varying amounts of blue light. Another window, in this group of three will pass varying amounts of green light, and the third window in this group of three will pass varying amounts of red light. These windows are so small that they appear to the eye as one small point of light, and essentially mix together to become one single colour. The image formed by all the groups of windows (known as pixels) is projected by the front lens system. The gobo wheel (35) and shutter mechanism (30) are no longer required to modify the light beam in any way since the same effects can be accomplished by controlling the pixels on the liquid crystal display (103) directly. This opens up a new dimension in lighting. Now gobos are no longer needed to shape the light beam. Instead, the desired pattern can be drawn by the CPU (512) directly on the liquid crystal display (103).

This allows computer animation to be projected by the light (10) as a form of special effect, and even opens the door to projecting onto the stage T.V. pictures that have been processed by the CPU (512). Colour selection is achieved by the same method as with the other two embodiments of the coloured light source.

The intensity of the three liquid crystal windows forming a pixel, determines the colour that is perceived at that pixel.

Referring now to FIG. 2*c*, the third embodiment of the control electronics will be discussed.

Control of the liquid crystal panel (103) is achieved by the control electronics (17). The control electronics (17) consists mainly of two parts, the image memory (180) and the matrix control electronics (181). The intensity of each liquid crystal window is loaded into the corresponding memory location in the image memory (180). This information is read by the matrix control electronics (181) which produces the control signals that vary the light transmitting properties of the liquid crystal windows. The image that appears on the liquid crystal display (103) is then projected by the front lens system (50). The control electronics (17) has the same resolution of control as the two previous embodiments of control electronics (15,16) and can produce the same range of colour temperatures and colour. The white light source (74) requires no control other than on and off. This removes the need to compensate for the varying colour temperature of the light source if the intensity of the source was variable. Further, there is no electrical noise from the on/off control circuit since this control is performed during the zero crossing of the power lines feeding the light source (74). Closed loop feedback through the monitoring circuit (501) eliminates fluctuations in the intensity of the light source (74) by maintaining a constant level of power to the light source (74).

Lastly, since the light source (74) does not require intensity control, there is no need to use an incandescent light source and other higher output light sources can be used in the light (10).

The special colour mixing mirrors (201,202,203) used in the first and second embodiments of the method of producing a coloured light beam in this invention are not commercially available from the usual sources of dichroic mirrors, and have to be custom manufactured for this light (10). Also, the liquid crystal devices (91,92,93,103) used in this invention need to be custom manufactured to produce the very high optical densities required to control the high output light sources. All lens elements (51,52,53,54,80,81,82,83,84) used in this invention have anti-reflective coatings to reduce surface reflections which increases the optical efficiency of this light (10).

I claim:

1. A lighting system for controlling the colour, colour temperature, magnification and focus of a light beam comprising:

a) means for providing a source of wide spectrum light of predetermined intensity, b) means for deflecting that portion of said beam having a wavelength of from 380 nm to 700 nm through a heat absorbing condenser lens, c) an electronically controlled colour generating prism having:

i) means for separating said deflected beam of light into a first portion, a second portion and third portion, ii) a first liquid crystal window for controlling the intensity of said first portion and a first colour mixing window immediately downstream from said crystal window for passing said first portion having a wavelength of from 524 nm to 535 nm and thereby producing a first colour portion of said light, iii) a second liquid crystal window for controlling the intensity of said second portion and a second colour mixing window immediately downstream therefrom for passing said second portion having a wavelength of from 555 nm to 570 nm and thereby produce a second colour portion of said light, iv) a third liquid crystal window for controlling the intensity of said third portion and a third colour mixing window immediately downstream of said crystal window for passing said second portion having a wavelength of from 445 nm to 450 nm and thereby produce a third colour portion of said light, v) means for discharging said first, said second and said third colour portions of light from said prism, d) means for recombining said first, second and said third colour portions of light downstream of said prism to provide a composite beam, said means including an electronically responsive circuit for varying the intensity of each of said colour portions separately to thereby provide said composite beam with a predetermined colour and intensity.

* * * * *